US011046502B2

(12) United States Patent
Rider et al.

(10) Patent No.: US 11,046,502 B2
(45) Date of Patent: Jun. 29, 2021

(54) REPLACEABLE BEVERAGE OUTLET AND CONDUIT FOR DISPENSER

(71) Applicant: Coravin, Inc., Bedford, MA (US)

(72) Inventors: Michael Rider, Lowell, MA (US); Otto DeRuntz, Dunstable, MA (US); Andrew S. Sweezey, Malden, MA (US)

(73) Assignee: Coravin, Inc., Bedford, MA (US)

( * ) Notice: Subject to any disclaimer, the term of this patent is extended or adjusted under 35 U.S.C. 154(b) by 0 days.

(21) Appl. No.: 16/689,432

(22) Filed: Nov. 20, 2019

(65) Prior Publication Data

US 2020/0156858 A1 May 21, 2020

Related U.S. Application Data

(60) Provisional application No. 62/770,320, filed on Nov. 21, 2018.

(51) Int. Cl.

| | |
|---|---|
| ***B65D 83/38*** | (2006.01) |
| ***B65D 83/44*** | (2006.01) |
| ***B65D 83/66*** | (2006.01) |

(52) U.S. Cl.

CPC ..... *B65D 83/382* (2013.01); *B65D 83/44* (2013.01); *B65D 83/663* (2013.01)

(58) Field of Classification Search

CPC ..... B65D 83/382; B65D 83/44; B65D 83/663
USPC ..... 222/82
See application file for complete search history.

(56) References Cited

U.S. PATENT DOCUMENTS

| | | | | |
|---|---|---|---|---|
| 5,020,395 | A * | 6/1991 | Mackey | B67B 7/08 141/19 |
| 8,910,829 | B2 * | 12/2014 | Lazaris | B67D 1/0004 222/5 |
| 9,061,878 | B2 * | 6/2015 | Lambrecht | B67D 7/0272 |
| 9,422,144 | B2 * | 8/2016 | Lambrecht | B67D 1/0412 |
| 9,758,362 | B2 * | 9/2017 | Rider | B67D 1/0412 |
| 2009/0101667 | A1 * | 4/2009 | Hasunuma | B67D 1/0406 221/278 |

(Continued)

FOREIGN PATENT DOCUMENTS

| | | |
|---|---|---|
| EP | 2 017 195 A1 | 1/2009 |
| EP | 2 562 129 A1 | 2/2013 |
| WO | WO 2009/068054 A2 | 6/2009 |

OTHER PUBLICATIONS

International Search Report and Written Opinion for International Application No. PCT/US2019/062406, dated Mar. 11, 2020.

*Primary Examiner* — Vishal Pancholi
(74) *Attorney, Agent, or Firm* — Wolf, Greenfield & Sacks, P.C.

(57) ABSTRACT

A beverage dispenser having replaceable dispensing components allows beverage-contacting elements to be removed and replaced. A needle or other conduit arrangement may be adapted for replacement, and the needle may be adapted to be inserted through a cork or other closure of a beverage container. A dispensing outlet may also be replaceable, allowing all beverage-contacting components to be replaced. The needle or other conduit may be engagable with a dispenser body by inserting a distal end of the needle into and through an opening in the body. A dispensing outlet may secure the needle to the body in an operation that fluidly connects the dispensing outlet to the needle.

16 Claims, 4 Drawing Sheets

(56) References Cited

U.S. PATENT DOCUMENTS

| | | | | |
|---|---|---|---|---|
| 2010/0276453 | A1* | 11/2010 | Vandaele | B01F 15/0203 222/152 |
| 2011/0204093 | A1* | 8/2011 | Lee | B67D 1/0418 222/152 |
| 2014/0097198 | A1 | 4/2014 | Lazaris et al. | |
| 2014/0124530 | A1* | 5/2014 | Craft | B67D 1/0418 222/23 |
| 2014/0217126 | A1* | 8/2014 | Peirsman | B67D 1/0004 222/399 |
| 2017/0144877 | A1 | 5/2017 | Rider et al. | |

* cited by examiner

REPLACEABLE BEVERAGE OUTLET AND CONDUIT FOR DISPENSER

RELATED APPLICATION

This Application claims priority under 35 U.S.C. § 119(e) to U.S. Provisional Application Ser. No. 62/770,320, entitled "REPLACEABLE BEVERAGE OUTLET AND CONDUIT FOR DISPENSER" filed on Nov. 21, 2018, which is herein incorporated by reference in its entirety.

BACKGROUND OF INVENTION

This invention relates generally to the dispensing or other extraction of fluids from within a container, e.g., in the dispensing of wine from a wine bottle. Beverage dispensers, including devices arranged to clamp to a container, are described in U.S. Pat. Nos. 9,010,588 and 7,712,637.

SUMMARY OF INVENTION

One or more embodiments in accordance with aspects of the invention allow a user to withdraw or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

In some embodiments, beverage-contacting components may be replaced between dispensing operations. This may allow a user to avoid cross-contamination, e.g., so a dispensed beverage does not have a taste or appearance that is negatively affected by a previously dispensed beverage. Replacement of beverage contacting components may also allow a user to avoid other problems, such as a clogged dispensing part, a worn or broken needle, etc. In some cases, a dispenser may have dispensing components that are dedicated for use with a particular type of beverage, and a user may replace the components depending on the type of beverage being dispensed. For example, a beverage dispensing device may include a body with a needle arranged to receive a flow of beverage under pressure from a beverage container and to dispense the beverage at a dispensing outlet of the device. The needle may include one or more lumens or passageways that receive beverage under pressure from a container, such as a wine bottle. In some embodiments, both the needle and the dispensing outlet may be replaceable, thereby replacing all portions of the dispenser that contact beverage during dispensing.

In one aspect of the invention, a container-mounted beverage dispenser includes a body adapted to be secured to a beverage container so as to support the dispenser on the beverage container, and at least one conduit removably attached to the body to deliver gas into a container holding a beverage and to receive beverage from the container for conducting the beverage out of the container. A dispensing outlet is removably attached to the body and fluidly coupled to the at least one conduit for receiving beverage and dispensing the beverage in a user's cup. At least one valve may be attached to the body to control gas flow into the container or beverage flow out of the container via the at least one conduit, e.g., to control dispensing of beverage, and a source of pressurized gas may be fluidly coupled to the at least one conduit.

In some embodiments, the at least one conduit and the dispensing outlet are the only portions of the dispenser that contact beverage during dispensing. As a result, all portions of the dispenser that contact a beverage may be replaceable. In some cases, the beverage-contacting portions may be arranged as a single part, and in others, may be arranged as two or more parts. In one embodiment, the at least one conduit includes a single conduit to deliver gas into the container and receive beverage from the container, and the at least one valve includes a gas valve adapted to control gas flow into the single conduit. The single conduit may be part of a needle arranged to be inserted through a cork in an opening of the container to position a distal end of the needle in an interior space of the container, and the needle may have an opening at the distal end to provide fluid communication with the single conduit, e.g., to deliver gas into the container and receive beverage from the container In another arrangement, the at least one conduit includes a first conduit to deliver gas into the container and a second conduit to receive beverage from the container. Thus, the at least one conduit may include two lumens, one each for gas and beverage flow. In some cases, the first and second conduits are part of a needle arranged to be inserted through a cork in an opening of the container.

In some embodiments, the dispensing outlet is formed as part of a cap arranged to removably engage with the body and secure the at least one conduit to the body. For example, the at least one conduit may include a first conduit to deliver gas into the container and a second conduit to receive beverage from the container, and the first and second conduits may be arranged as a single piece arranged to be inserted into an opening of the beverage container. A hub may be mounted to a proximal end of the first and second conduits with the hub being adapted to secure the first and second conduits to the body. In some cases, the cap may be arranged to engage the body to secure the hub to the body and to fluidly connect the dispensing outlet to the second conduit.

In some configurations, the dispenser may include a controller adapted to automatically control the at least one valve to allow gas flow in the at least one conduit to pressurize an interior space of the beverage container. The at least one valve may include a gas control valve arranged to control flow of gas from the source of pressurized gas to the at least one conduit, and/or a beverage control valve arranged to control flow of beverage from the at least one conduit to the dispensing outlet.

In some embodiments, the dispenser includes a clamp attached to the body with the clamp arranged to removably attach the body to the container, e.g., so that the dispenser can be supported by the clamp on the container. The body may be movable relative to the clamp to insert the at least one conduit into an interior space of the container, e.g., the at least one conduit may be part of a needle arranged to be inserted through a cork in an opening of the container by moving the body downwardly relative to the clamp.

In another aspect of the invention, a container-mounted beverage dispenser includes at least one conduit to deliver gas into a beverage container holding a beverage and to receive beverage from the container for conducting the beverage out of the container. The at least one conduit may be arranged as discussed above, e.g., with one or more lumens, including a hub at a proximal end, etc. A body of the dispenser may be adapted to be secured to the beverage container so as to support the dispenser on the beverage container, e.g., using a clamp that engages the container neck. The body may have an opening to receive and engage with the at least one conduit with the at least one conduit being receivable into the opening by inserting a distal end of the at least one conduit into the opening and then engaging a proximal end of the at least one conduit to the body at the opening. For example, the at least one conduit may be arranged as a needle having a hub at a proximal end, and the needle may be engaged with the body by inserting the distal end of the needle into the opening of the body and extending the needle through the opening so that the hub is engaged with the body at the opening. At least one valve may be attached to the body to control gas flow into the container or beverage flow out of the container via the at least one conduit, and a source of pressurized gas may be fluidly coupled to the at least one conduit.

In some embodiments, a dispensing outlet may be removably attached to the body and fluidly coupled to the at least one conduit for receiving beverage and dispensing the beverage in a user's cup. For example, the dispensing outlet may be arranged to secure the at least one conduit to the body. In some configurations, the dispensing outlet may be part of a cap arranged to removably engage with the body and secure the at least one conduit to the body, e.g., the cap may be engaged with the body over the hub of a needle to trap the needle in the opening of the body.

In some embodiments, the dispenser may have a controller adapted to automatically control the at least one valve to allow gas flow in the at least one conduit to pressurize an interior space of the beverage container. The at least one valve may include a gas control valve arranged to control flow of gas from the source of pressurized gas to the at least one conduit, as one example. Other optional features of the dispenser are discussed in more detail below.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

Figure 1:
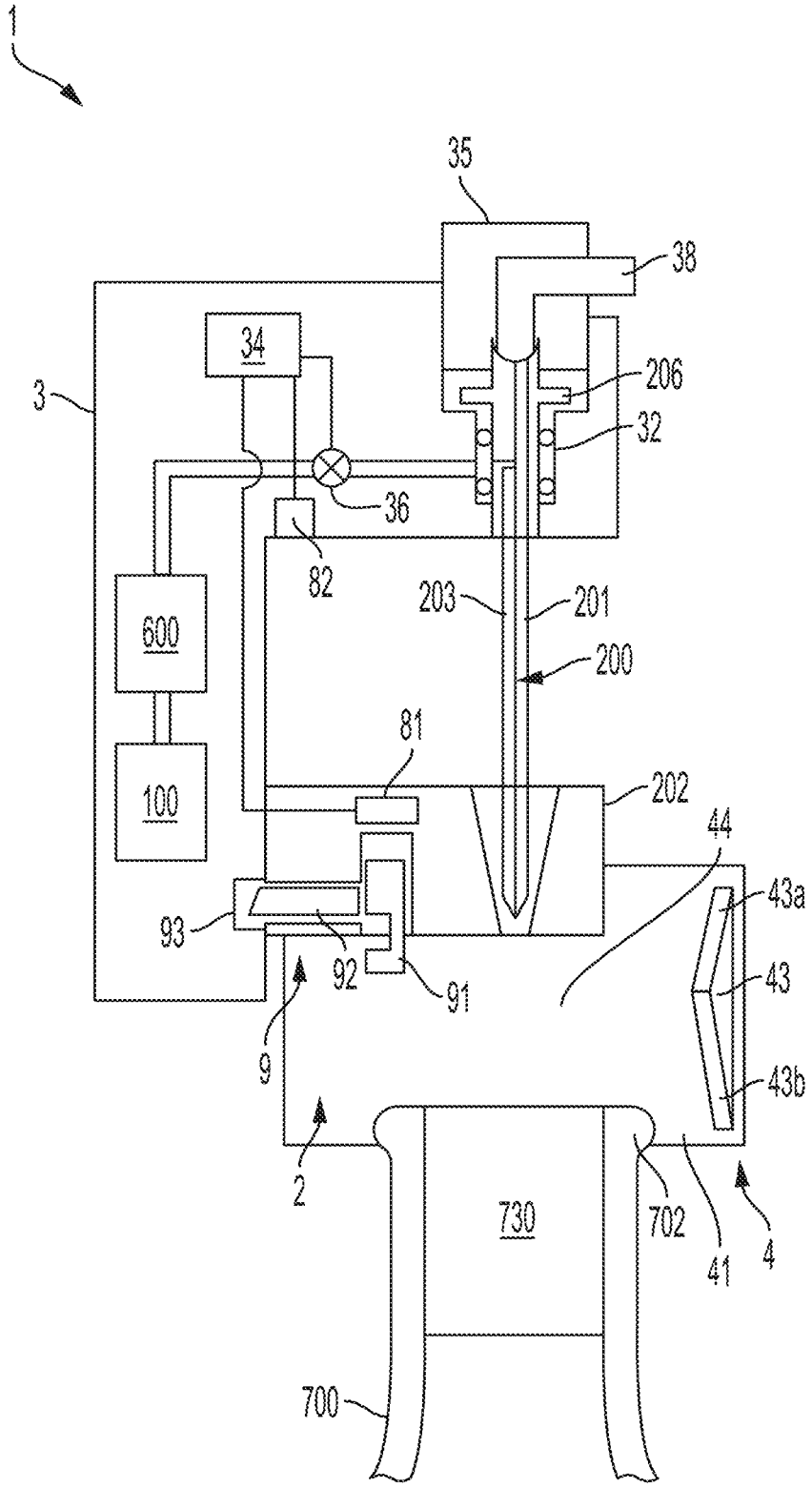
FIG. 1 shows a schematic view of a beverage dispensing device in preparation for introducing a conduit through a closure of a beverage bottle.

FIG. 1 shows a schematic view of one embodiment of a beverage dispensing system (or device) 1 that incorporates one or more aspects of the invention. Generally, the device 1 is used to insert a needle or other conduit into a beverage container 700, inject gas into the container 700 via the conduit, and dispense beverage forced out of the container 700 by the injected gas or other pressure in the container. This illustrative device 1 includes a body 3 with an attached source of pressurized gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level. In other embodiments, no pressure regulation of the gas released from the cylinder 100 need be done, and instead, unregulated gas pressure may be delivered to the container 700.

Embodiments include at least one valve to control the flow of gas into and/or a flow of beverage from the container 700. In this embodiment, a gas control valve 36 is provided to control the flow of gas from the gas source 100 to a flow path in fluid communication with the interior of the container 700. Optionally, a beverage control valve (not shown) may be provided to control the flow of beverage from the container 700 to a dispensing outlet 38, but is not employed in this embodiment. Other arrangements are possible, e.g., a single valve may control the flow of both gas and beverage (e.g., using a three-way valve), a single valve may be used to control beverage flow only (e.g., gas flow from the gas source 100 to the container 700 may be always open with the device 1 engaged with a container 700 and beverage flow may be controlled by opening/closing a beverage control valve only). The gas control valve 36 and/or other valves if used may be controlled by a controller 34, i.e., control circuitry. For example, the controller 34 may detect when the device 1 is engaged with a container 700 and/or that a conduit is in fluid communication with an interior space of the container 700, e.g., by detecting that the needle has been inserted through a cork or a device clamp 4 is engaged with a container neck, and then control the valve(s) accordingly. Where not controlled by a controller 34, the gas control valve 36 may be manually operable by a user, and/or a user may provide input to the controller 34 via a user interface (button, touch screen, etc.) to cause the valve to open and/or close. As another option, where multiple valves are used, operation of the valves may be tied together, whether mechanically or via electronic control, e.g., so that when a gas control valve 36 is opened, the beverage control valve is closed, and vice versa, or so that when one valve is open the other valve is open as well (such as when using a two lumen needle to access the interior of the container 700).

To introduce gas into the container 700 and extract beverage, at least one conduit is put in fluid communication with the interior of the container 700. In this embodiment, a needle 200 attached to the body 3 is inserted through a cork or other closure 730 that seals an opening at a neck of the container 700. In this illustrative device 1, the needle 200 includes two lumens or conduits with at least one needle opening along a sidewall of the needle near the needle tip or distal end of the needle 200 to provide fluid communication with the lumen(s) of the needle 200. While the needle 200 may be inserted into and through the cork or other closure 730 in different ways, in this embodiment, the device 1 includes a base 2 which may be secured to the container 700 by a clamp 4. As will be appreciated, a beverage dispensing device may benefit from a clamp or other arrangement configured to engage the device 1 with a container 700, e.g., by clamping the device 1 to the neck of a bottle so the device is supported on the bottle. The device can include one or more clamp arms 41 that are movably mounted to the base 2 that are arranged to engage with a bottle. Thus, the clamp may receive a container neck into a receiving space 44 of the clamp 4. In this embodiment, clamp arms 41 (only one shown in FIG. 1) are spring biased to move relative to the base 2 to exert an engagement force on the container neck. The spring biased nature of the clamp engagement may also allow the clamp 4 to accommodate differently sized container necks. Alternately, the clamp 4 may secure the base 2 to the container neck in other ways, such as by securing a ratcheting strap, buckle, threaded fastener, etc.

The body 3 may be movable relative to the base 2, e.g., a rail on the body 3 may move within a corresponding channel of the base 2. Thus, movement of the body 3 and attached needle 200 relative to the container closure 730 may be guided by the base 2, e.g., the body 3 may slide relative to the base 2 between an upper position and a lower position to move the needle 200 into/out of the closure 730. In addition, movement of the needle 200 may be guided by a needle guide 202 that is attached to the base 2 and positioned over the closure 730. To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rail and channel). Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

With the needle 200 suitably inserted through the closure 730, the distal end of the needle 200 may be positioned below the closure 730 and within the interior space of the container 700. This allows fluid communication between the interior of the container 700 and one or more conduits of the needle 200. In embodiments where a needle 200 includes one lumen or conduit, the valve 36 may be controlled to provide pressurized gas into the container 700 and allow beverage to flow from the container 700. For example, gas may first be introduced into the container 700 via a single of the needle conduit to establish a pressurized condition in the container 700, and then gas flow may be stopped and pressurized beverage may be permitted to flow out of the single conduit to the dispensing outlet 38. Where the needle 200 includes two lumens or conduits (or two or more needles are used), one or more conduits may be dedicated to gas flow into the container and one or more other conduits may be dedicated to beverage flow. Thus, the gas control valve 36 may control gas flow into the gas conduit(s), and a beverage control valve may be provided to control beverage flow from the beverage conduit(s). It should be appreciated that use of a needle or other structure capable of penetrating a cork or other closure is not necessary. Instead, any suitable hose, pipe, tube or other conduit may be used as a needle, e.g., a cork may be removed and the conduits fluidly coupled to the container 700, e.g., by a plug, stopper or cap through which the conduit(s) extend. Thus, a needle need not be made capable of penetration though a bottle cork or other closure.

In accordance with an aspect of the invention, the dispensing device includes beverage contacting components that may be removed and replaced by other components. As discussed above, this may allow a user to avoid cross contamination when dispensing different beverages. In this embodiment, the device 1 includes a replaceable needle 200 and dispensing outlet 38. Since the beverage lumen 201 of the needle 200 and the dispensing outlet 38 are the only portions of the device that contact beverage during dispensing, all beverage-contacting portions of the device 1 may be replaced, as desired. Although a needle 200 or other conduit arrangement and dispensing outlet 38 may be removable engaged with a device 1 in different ways, in this embodiment the needle 200 includes a pair of lumens 201, 203 that are attached together and extend from a hub 206 which is engaged in an opening 32 of the body 3. To remove the needle 200 from the body 3, a cap 35 is first removed since the cap 35 acts to secure the needle 200 in engagement with the body 3. With the cap 35 removed, the needle 200 may be moved upwardly from an opening 32 of the body 32 so that the hub 206 is moved upwardly and out of the opening 32. The needle 200 may be further withdrawn until the distal end of the needle 200 exits the opening 32. To replace a new needle 200, a distal end of the needle 200 may be first inserted into the opening 32 and the needle 200 extended through the opening 32 until the hub 206 is engaged with (e.g., received into) the opening 32 as shown in FIG. 1. The dispensing outlet 38 may also be releasably engaged with the opening, and in this embodiment the dispensing outlet 38 is formed as part of the cap 35 that is attachable to the body 3 over the hub 206 of the needle 200. Engagement of the cap 35 with the body 3 may serve a few purposes, including securing the hub 206 in the opening 32, and fluidly coupling the dispensing outlet 38 with the beverage lumen 201 of the needle 200. The cap 35 may engage the body 3 in different ways, such as by a bayonet connection, a threaded connection, one or more screws or other fasteners, etc. Also, although the needle 200 and cap 35 are arranged as two separate parts in this embodiment, the cap 35 and needle 200 may be made as one piece so that engagement of the one-piece cap 35 and needle 200 attaches the beverage-contacting conduit of the needle 200 and the dispensing outlet 38 to the body 3 in one operation. In other arrangements, the dispensing outlet 38 may be made as one piece with the needle 200 or other beverage conduit 201. Thus, the dispensing outlet 38 need not be made part of a cap 35 or other similar structure.

Figure 2:
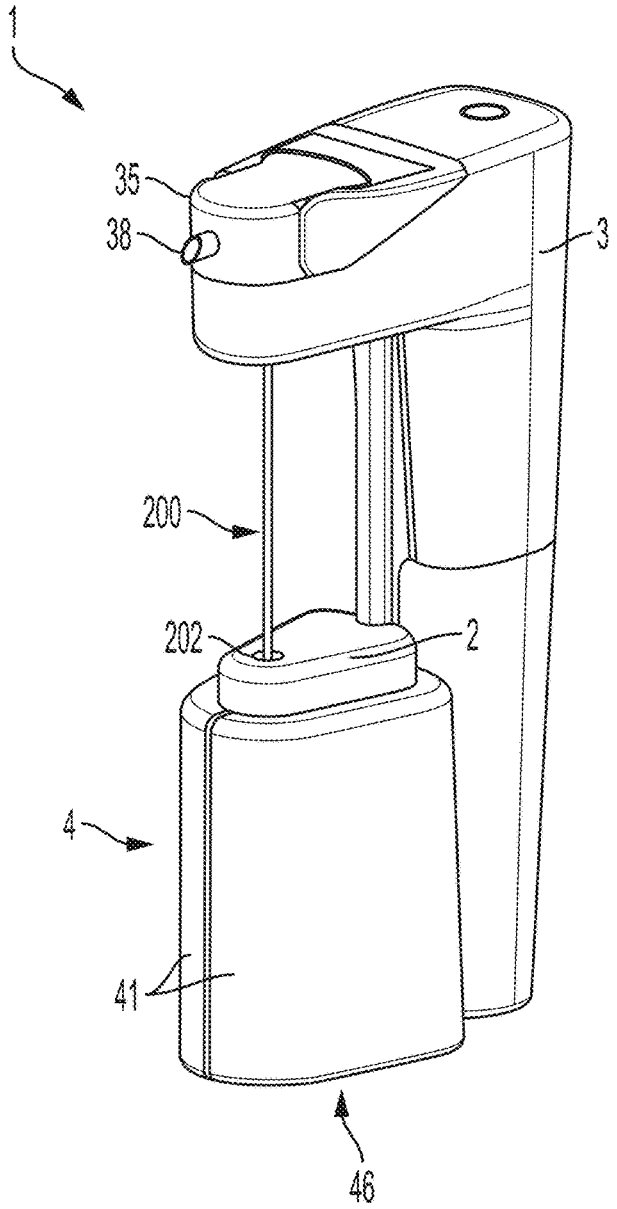
FIG. 2 shows a perspective view of a dispensing device in an illustrative embodiment.
Figure 3:
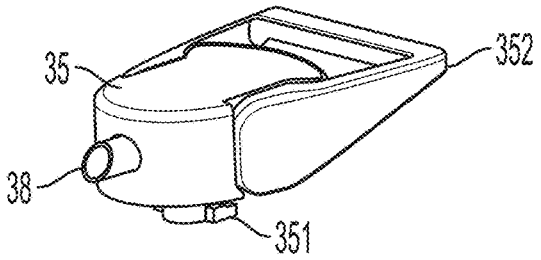
FIG. 3 shows a cap with a dispensing outlet removed from the dispensing device of the FIG. 2.
Figure 4:
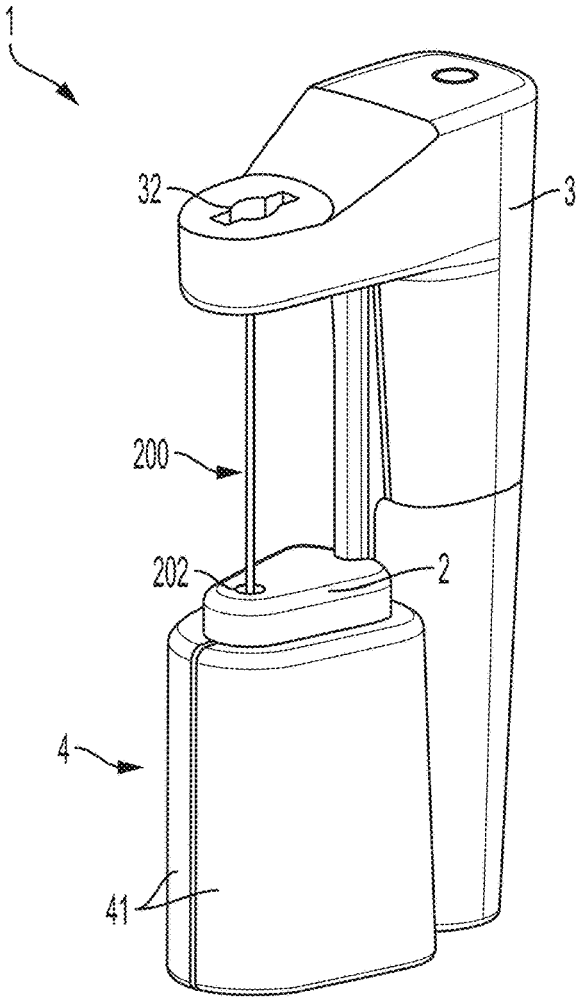
FIG. 4 shows the FIG. 2 embodiment with the cap removed.

FIGS. 2-4 show an illustrative embodiment of a dispensing device 1 that includes the features of FIG. 1. The body 3 is movable vertically, in an up-and-down direction, relative to the base 2, e.g., in a direction along a length of the needle 200 so that movement of the body 3 relative to the base 2 can insert the needle 200 into and through a closure 730 of a container 700. FIG. 2 also shows two clamp arms 41 of the clamp 4 in this embodiment which can receive and engage with a container neck, e.g., so that the device 1 is fully supported and suspended on the container 700. In this illustrative embodiment, the clamp arms 41 are pivotally mounted to the base 2 such that the arms 41 are normally biased to move toward each other, e.g., to clamp a bottle neck positioned between the arms 41. However, the clamp arms 41 may be movably mounted relative to the base 2 in other ways, such as by a linkage, living hinge, and others. Also, one arm may be fixed to the base while the other is made movable (although in this embodiment the arms are still said to be moveable relative to each other). Torsion or other springs may be used to provide the biasing force (if provided at all) on the clamp arms 41. The clamping force of the clamp arms 41 may be sufficiently robust to support the device 1 on the bottle 700, or even to allow a user to lift and pour beverage from the bottle 700 by grasping and manipulating the device 1.

As shown in FIG. 1, the clamp arms 41 may each include an engagement surface 43 that can contact the container neck and aid in the clamp 4 engaging with the container neck. In this embodiment, the arms 41 define a receiving space 44 between the arms 41 where the container neck is received and engaged by the clamp 4. The arms 41 define an entry opening 46 at a bottom end of the clamp 4 (see FIG. 2) which may be sized and shaped to allow the top of a container neck to be introduced between the arms 41 so that the arms 41 can be forced downward onto the container neck. The engagement surfaces 43 may contact the container neck, e.g., at a lip 702, to aid in entry of the container neck into the receiving space 44. In this embodiment, the engagement surfaces 43 extend vertically on the respective clamp arm 41, e.g., to help guide movement of the container neck in its travel into the receiving space 44. The engagement surfaces 43 may have a relatively hard, low-friction surface to help allow the clamp arms 41 engage the neck while allowing the neck to shift in position relative to the clamp arms 41. A lower portion 43*b* of the engagement surfaces may slope inwardly and upwardly relative to the receiving space 44 and may contact the container neck to move the arms 41 away from each other to enlarge the receiving space 44 and allow the container neck to move into the receiving space 44. The sloped nature of the lower portion 43*b* may allow the clamp 4 to accommodate differently sized and shaped container necks as well as provide relatively gradual movement of the clamp arms 41 away from each other against the spring bias urging the arms 41 together as the container neck is received. As noted above, the arms 41 may be biased toward each other by a relatively high force of a spring. However, the sloped arrangement of the engagement surfaces 43 may provide suitable mechanical advantage to a user pressing downwardly on the clamp 4 to force the arms 41 apart and seat the container neck in the receiving space 44. The container neck may be received until contacting a needle guide 202 or other stop, which prevents further movement of the container neck into the receiving space 44. The engagement surfaces 43 may include an upper portion 43*a* that ramps or slopes upwardly and outwardly relative to the receiving space 44. This arrangement may provide at least two functions, i.e., helping maintain the container neck seated at a fully received position in the receiving space 44 and/or aiding in removal of the clamp 4 from the container neck. To maintain the container neck seated at a fully received position in the receiving space 44, the upper portion 43*a* may exert a radially inward and upward force on the container neck, e.g., at the lip 702, (or from the reference point of the container, a radially outward and downward force on its clamp arm 41) that helps keep the container neck in contact with the needle guide 202 or other stop. That is, while both the upper and lower portions 43*a*, 43*b* may exert a radially inward force on the container neck, the upper portion 43*a* may exert an upward force on the container neck due to its sloping upwardly and outwardly relative to the receiving space 44. This may help urge the container neck to move upwardly relative to the clamp 4 (or urge the clamp 4 to move downwardly relative to the container 700 depending on the frame of reference). To aid in removal of the clamp 4, the upper portions 43*a* may allow the clamp 4 to be removed from the container neck by simply pulling upwardly on the clamp 4 relative to the container 700. In the same way that the lower portions 43*b* may assist in receiving the container neck into the receiving space 4 by forcing the clamp 4 downwardly onto the container, the upper portions 43*a* may assist in removal of the neck from the receiving space 44. For example, the upper portions 43*a* may contact a lip 702 of the container neck and urge the arms to move outwardly and away from the container neck as the clamp 4 is move upwardly relative to the container 700.

To aid in engagement of the clamp 4 in the FIGS. 1-4 embodiment by pressing the clamp 4 downwardly on the container 700, a latch 9 as shown in FIG. 1 may be provided to lock the body 3 in an upper position relative to the base 2. This can allow a user to grasp the body 3 and push downwardly to engage the clamp 4 with the container 700 without inserting the needle 200 into the closure 730. In this illustrative embodiment, a latch 9 is implemented by a movable latch bolt 92 that is mounted to the base 2 and can move to the left under a spring bias to engage with a latch slot 93 in the body 3 when the body 3 is in an upper position relative to the base 2 as shown in FIG. 1. A latch slide 91 is mounted to the base 2 and is spring biased to move downwardly in the position shown in FIG. 1 to block movement of the bolt 92 to the right. Thus, the body 3 is prevented from moving relative to the base 2 so long as the bolt 92 is engaged with the slot 93 and the slide 91 prevents movement of the bolt 92 to the right. This allows a user to grasp the body 3 and force the clamp 4 downwardly over a container neck so the container neck is received into the receiving space 44, e.g., as guided by one or more engagement surfaces 43 as discussed above. The engagement of the clamp 4 with the container may be performed without the body 3 moving downwardly relative to the base 2. However, the slide 91 is arranged so that when the top of a container neck is fully received into the receiving space 44 of the clamp 4, the top of the container neck contacts the slide 91 and moves the slide 91 upwardly against the spring bias. This aligns a notch in the slide 91 with the bolt 92, allowing the bolt 92 to move to the right. The upper positioning of the slide 91 may be detected by a container sensor 81, which may include a switch that is actuated (closed or opened) by upward positioning of the slide 91. With the notch of the slide 91 aligned with the bolt 92, downward force on the body 3 relative to the base 2 causes a portion of the body 3 to contact a ramp on the end of the bolt 92, forcing the bolt 92 to move to the right and into the notch of the slide 91. This clears the latch 9 and the body 3 can continue downward movement relative to the base 2, thereby inserting the needle 200 as guided by the needle guide 202 into the closure 730 of the container. When the body 3 is positioned in its lower position relative to the base 2, the needle 200 is fully inserted and the needle sensor 82 may detect that the body 3 is in its lower position, e.g., by a switch being actuated by contact with the base 2. The controller 34 may receive information from the container and needle sensors 81, 82, and in response take desired action, such as starting a dispensing operation, allowing manual or automatic operation of the gas control valve 36, and so on.

In arrangements where the clamp arms 41 are biased to move apart or are not biased at all, a locking mechanism may be used to engage the clamp arms 41 to the bottle. That is, whether the clamp arms 41 are spring biased or not, movement of the arms may be restricted or otherwise controlled in some way by a locking mechanism. For example, the arms 41 may be secured together by a ratchet and pawl mechanism that allows the clamp arms 41 to move freely toward each other, but prevents movement of the arms 41 away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the bottle 700.

FIG. 3 shows the cap 35 of the dispensing device 1 of FIGS. 1-4, and FIG. 4 shows the device 1 with the cap 35 removed from the body 3. With the cap 35 removed, the opening 32 of the body 3 that receives the needle 200 is exposed. This allows a user to move the needle 200 upwardly relative to the body 3 to remove the needle 200 from the device 1. With a used needle 200 removed, another replacement needle 200 may be inserted into the opening 32 by inserting the distal end of the needle 200 into the opening 32 and continuing to insert the needle 200 until the hub 206 is received in the opening 32. Thereafter, a replacement cap 35 (or the previously used cap 35) may be engaged with the body 3 to secure both the cap 35 and the needle 200 in place. FIG. 3 shows a bayonet connection 351 of the cap 35 in this embodiment that is used to secure the cap 35 to the body 3, e.g., by engaging the bayonet features with corresponding engagement features at the opening 32. In this embodiment, the cap 35 includes a handle 352 that is pivotable on the cap 35 to flip the handle 352 upwardly from the position in FIG. 3. This allows the handle 352 to be gripped by a user to twist the cap 35 to engage the bayonet features 351 with the opening 32. After engagement of the cap 35 with the body 3, the handle 352 may be folded downwardly again to the position shown in FIGS. 2 and 3. Engagement of the cap 35 with the body 3 may not only secure the needle 200 to the body 3, but also fluidly couple the dispensing outlet 38 with the beverage-carrying lumen of the needle 200. For example, a portion of the dispensing outlet 38 may be inserted into an opening of the hub 206 so as to sealingly engage the dispensing outlet 38 with the hub 206 so beverage can be conducted from the needle 200 to the dispensing outlet 38.

FIGS. 5-8 show a needle 200 that may be used with the FIGS. 1-4 embodiment. As described above, the needle 200 includes the first lumen 201 and the second lumen 203 which extend from a proximal end to a distal end, and respectively have first and second openings 204, 205 at a distal end. In this embodiment, the first lumen 201 is arranged to carry a flow of beverage liquid received at the first opening 204, through the first lumen 201 and to the dispensing outlet 38 of the extraction device 1. The second lumen 203 is arranged to carry a flow of pressurized gas from the gas source 100 to the second opening 205, e.g., to deliver gas and pressurize the interior of the container 700. Because the first lumen 201 is arranged carry a flow of liquid, the first lumen 201 may have a larger cross sectional area (where the cross section is taken in a plane perpendicular to the length of the needle 200) than the second lumen 203, which carries a flow of gas. The larger cross sectional area of the first lumen 201 may help reduce a resistance to flow of liquid, and thus help support a higher flow rate as compared to a lumen having a smaller cross sectional area. However, it is not necessary for the first and second lumens 201, 203 to have a different cross sectional area or other size.

As also mentioned above, the hub 206 is attached at the proximal ends of the first and second lumens 201, 203. The hub 206 may be arranged to facilitate connection or other coupling of the first and second lumens 201, 203 to corresponding flow channels or conduits of the device 1. For example, the hub 206 in this case includes a body 61 with a gas port 62 that extends through the body 61 and fluidly communicates with the second lumen 203. The gas port 62 may be arranged to couple with a corresponding port or other structure of the device 1 to fluidly connect the gas source with the second lumen 203. In this embodiment, the hub 206 includes a first gasket 63 positioned proximally of the gas port 62 and a second gasket 64 positioned distally of the gas port 62. As shown in FIG. 1, this allows the hub 206 to be received into the opening 32 of the body 3 so that the first and second gaskets 63, 64 sealingly engage with the opening 32. As a result, the gas port 62 is fluidly coupled with a space in the opening 32 that is fluidly coupled to the gas source. Of course, other arrangements are possible for fluidly coupling a gas port 62 to a gas source, such as an o-ring or other gasket positioned around the opening of the gas port 62 that sealingly engages with a corresponding port or other opening when the hub 206 is received by the extraction device 1, a threaded connection of the hub 206 to the device 1, and so on.

In this embodiment, the hub 206 also includes first and second tabs 65, 66 that extend away from each other in a direction perpendicular or otherwise transverse to a length of the first and second lumens 201, 203. These tabs 65, 66 may engage with corresponding slots in the opening 32 of the body 3 when the hub 206 is engaged with the device 1, e.g., to help resist rotation of the needle 200 relative to the device 1 about axes that are parallel to the length of the needle 200, or other movement of the needle 200, such as in a direction along the length of the needle. Thus, the tabs 65, 66 may provide bayonet-type engagement features that help serve to lock the hub 206, and therefore the needle 200, to the device 1 in at least one range of motion. In this illustrative embodiment, the first tab 65 is longer than the second tab 66. This feature may help ensure that the hub 206 is positioned in a particular way with respect to the device 1 when the needle 200 is engaged with the device 1. For example, the opening 32 of the device 1 may include a first and second slots that respectively receive and engage with the first and second tabs 65, 66. The first slot may be longer than the second slot so that the hub 206 can only be received with the first tab 65 in the first slot. Engagement of the tabs 65, 66 with the slots may help resist rotation of the hub 206 relative to the device 1. The second tab 66 is wider than the first tab 65 in this embodiment, and this feature may be exploited as well to help ensure proper orientation of the hub 206 with the device 1.

The hub 206 in this illustrative embodiment also includes an opening 67 at a proximal end of the body 61 that is in fluid communication with the first lumen 201. The body 61 and opening 67 may be arranged to facilitate fluid coupling of the first lumen 201 with the dispensing outlet 38 of the device 1. For example, engagement of the cap 35 with the body 3 may fluidly couple the dispensing outlet 38 of the cap with the opening 67 of the hub 206. In one embodiment, the end of a tube in the cap 35 may fit within the opening 67 to sealingly engage with the hub 206 so beverage exiting the first lumen 201 passes to the dispensing outlet 38 of the cap. In this embodiment, the body 61 includes a notch 68 that permits a portion of the dispensing outlet conduit that engages with the opening 67 (e.g., a tube) to extend away from the hub 206 in a direction transverse to the length of the needle 200. This may help reduce the overall height of the cap, but is not a required feature.

Figure 5:
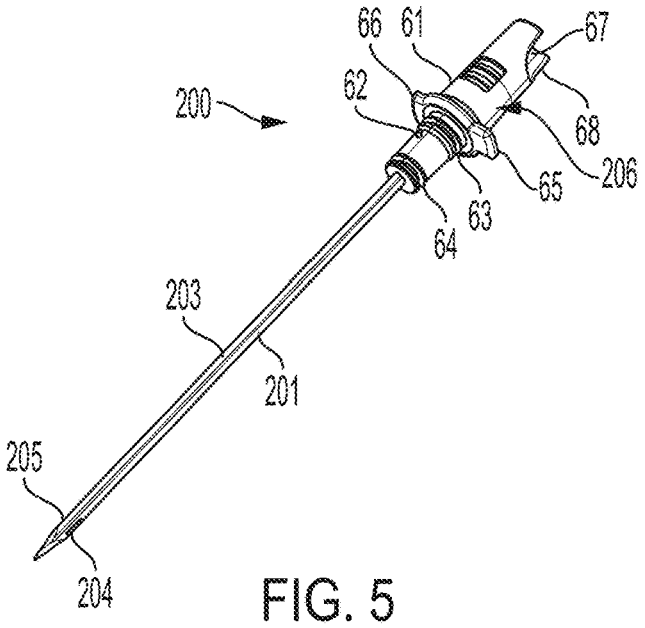
FIG. 5 shows a perspective view of a needle in an illustrative embodiment.
Figure 6:
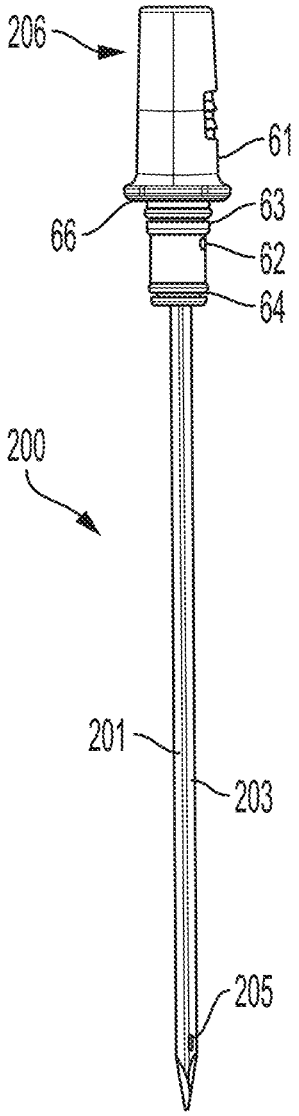
FIG. 6 shows a front view of the needle of FIG. 5.
Figure 7:
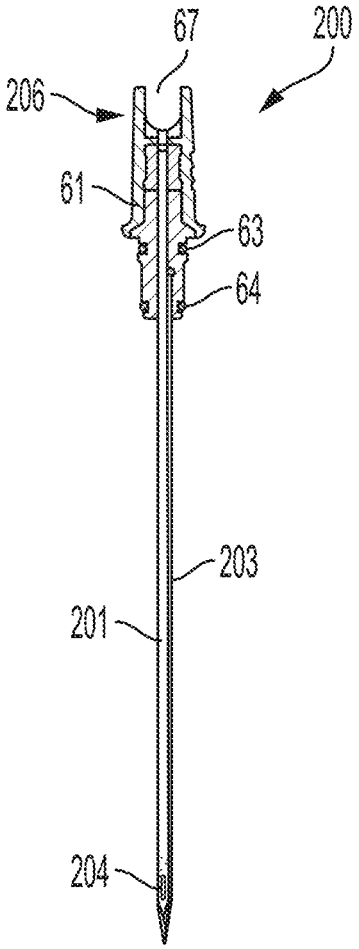
FIG. 7 shows a cross sectional view of the FIG. 5 needle along the line 7-7 in FIG. 8.
Figure 8:
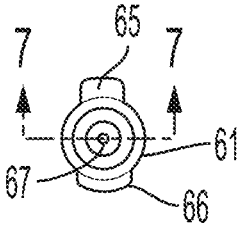
FIG. 8 is a top view of the FIG. 5.

Another feature of the needle 200 is that the hub 206 is constructed and arranged to support the first and second lumens 201, 203 to penetrate through a cork of a wine bottle (or other closure of a beverage container) by inserting the distal ends of the first and second lumens 201, 203 through the cork while the needle 200 is supported only by the hub 206. Thus, the hub 206 may be engaged with the device 1, and the first and second lumens 201, 203 may extend away from the device 1 and be suitably supported to allow the first and second lumens 201, 203 to be inserted through a cork or other closure to access the container interior. As discussed above, passing the distal end of the needle 200 through a cork or other closure will put the first and second lumens 201, 203 in fluid communication with container interior via the first and second openings 204, 205. As shown in FIGS. 5-7, a single pointed end may be provided at the distal ends of the first and second lumens 201, 203 to aid in penetrating a cork or other closure.

A needle 200 having a smooth walled exterior and a pencil point or Huber point may be effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor (such as when an inert or otherwise suitably non-reactive or low-reactive gas is injected into the container during dispensing). While multiple needle gauges can work, preferred needle gauges (e.g., corresponding to a dimension along a needle cross sectional major axis) range from 16 to 22 gauge (i.e., outer dimension of 1.65 mm to 0.91 mm), with an optimal needle gauge in some embodiments being between 17 and 20 gauge (i.e., outer dimension of 1.47 mm to 1.07 mm). These needle gauges may offer optimal fluid flow with minimal pressures inside the container while doing an acceptably low level of damage to the cork even after repeated insertions and extractions. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system. In some arrangements, a needle need not be arranged to allow for cork resealing after removal. Instead, a needle may form an opening in a cork that is too large to allow the cork to reseal.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) When two or more needles are used, the needle lengths may be the same or different and vary from 0.25 inches to 10 inches.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiments above, a single needle with two lumens is used to introduce gas into the bottle and extract beverage from the bottle. However, in other embodiments two or more needles may be used, e.g., one needle for gas delivery and one needle for beverage extraction. In such an embodiment, one or both of the needles may be made replaceable. The needles may have the same or different diameters or the same or different length varying from 0.25 to 10 inches. For example, one needle or conduit delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Control of the system may be performed by any suitable control circuitry of the controller 34, which may include a programmed general purpose computer and/or other data processing device along with suitable software or other operating instructions, one or more memories (including non-transient storage media that may store software and/or other operating instructions), a power supply for the control circuitry and/or other system components, temperature and liquid level sensors, pressure sensors, RFID interrogation devices or other machine readable indicia readers (such as those used to read and recognize alphanumeric text, barcodes, security inks, etc.), input/output interfaces (e.g., such as the user interface to display information to a user and/or receive input from a user), communication buses or other links, a display, switches, relays, triacs, motors, mechanical linkages and/or actuators, or other components necessary to perform desired input/output or other functions.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A container-mounted beverage dispenser, comprising:

at least one conduit to deliver gas into a beverage container holding a beverage and to receive beverage from the container for conducting the beverage out of the container, the at least one conduit having a distal end opposite a proximal end;

a body adapted to be secured to the beverage container so as to support the dispenser on the beverage container, the body having an opening to receive and engage with the at least one conduit, the at least one conduit being receivable into the opening by inserting the distal end of the at least one conduit into the opening and then engaging the proximal end of the at least one conduit to the body at the opening;

at least one valve attached to the body to control gas flow into the container or beverage flow out of the container via the at least one conduit; and a source of pressurized gas fluidly coupled to the at least one conduit.

2. The dispenser of claim 1, further comprising a dispensing outlet removably attached to the body and fluidly coupled to the at least one conduit for receiving beverage and dispensing the beverage in a user's cup.

3. The dispenser of claim 2, wherein the dispensing outlet is arranged to secure the at least one conduit to the body.

4. The dispenser of claim 1, wherein the at least one conduit includes a first conduit to deliver gas into the container and a second conduit to receive beverage from the container.

5. The dispenser of claim 4, wherein the first and second conduits are part of a needle arranged to be inserted through a cork in an opening of the container.

6. The dispenser of claim 5, wherein the at least one conduit includes a hub attached at a proximal end of the first and second conduits.

7. The dispenser of claim 1, further comprising a cap arranged to removably engage with the body and secure the at least one conduit to the body.

8. The dispenser of claim 7, wherein the at least one conduit includes a first conduit to deliver gas into the container and a second conduit to receive beverage from the container.

9. The dispenser of claim 8, wherein the first and second conduits are arranged as a single piece arranged to be inserted into an opening of the beverage container.

10. The dispenser of claim 9, wherein the at least one conduit includes a hub mounted to a proximal end of the first and second conduits, the hub being adapted to secure the first and second conduits to the body.

11. The dispenser of claim 10, wherein the cap is arranged to engage the body to secure the hub to the body.

12. The dispenser of claim 1, further comprising a controller adapted to automatically control the at least one valve to allow gas flow in the at least one conduit to pressurize an interior space of the beverage container.

13. The system of claim 1, wherein the at least one valve includes a gas control valve arranged to control flow of gas from the source of pressurized gas to the at least one conduit.

14. The system of claim 1, further comprising a clamp attached to the body, the clamp being arranged to removably attach the body to the container.

15. The system of claim 14, wherein the body is movable relative to the clamp to insert the at least one conduit into an interior space of the container.

16. The system of claim 15, wherein the at least one conduit is part of a needle arranged to be inserted through a cork in an opening of the container to put the at least one conduit in fluid communication with the interior of the container.

* * * * *